US010721551B1

(12) United States Patent
Bikumala et al.

(10) Patent No.: US 10,721,551 B1
(45) Date of Patent: Jul. 21, 2020

(54) ADJUSTING A SIZE OF HEADPHONE CUSHIONS

(71) Applicant: Dell Products L. P., Round Rock, TX (US)

(72) Inventors: Sathish Bikumala, Round Rock, TX (US); Parminder Singh Sethi, Ludhiana (IN); Anshul Saxena, Bareilly (IN)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/260,279

(22) Filed: Jan. 29, 2019

(51) Int. Cl.
*H04R 1/10* (2006.01)
*H04R 1/08* (2006.01)
*H04R 1/02* (2006.01)

(52) U.S. Cl.
CPC ..... *H04R 1/1066* (2013.01); *H04R 1/025* (2013.01); *H04R 1/083* (2013.01); *H04R 1/1008* (2013.01)

(58) Field of Classification Search
CPC ..... H04R 1/1066; H04R 1/025; H04R 1/083; H04R 1/1008; H04R 1/105; H04R 1/1091; H04R 3/04; H04R 5/04; A42B 3/145
See application file for complete search history.

(56) References Cited

U.S. PATENT DOCUMENTS

| | | | | |
|---|---|---|---|---|
| 10,455,314 | B1 * | 10/2019 | Yang | H04R 1/1008 |
| 2012/0063626 | A1 * | 3/2012 | Peng | H04R 1/2803 381/345 |
| 2016/0198254 | A1 * | 7/2016 | Gecawicz | H04R 1/083 381/375 |
| 2017/0201820 | A1 * | 7/2017 | Inoue | H04R 1/1041 |

* cited by examiner

*Primary Examiner* — Sunita Joshi
(74) *Attorney, Agent, or Firm* — Campbell Stephenson LLP; Shiv S. Naimpally

(57) ABSTRACT

For example, a headphone includes a headband, a first housing with a first cushion and a first size selector, and a second housing with a second cushion and a second size selector. A linkage connects the first size selector to the second size selector. If the linkage is engaged, moving the first size selector in a first direction causes the first cushion and the second cushion to simultaneously increase from a first size to a second size. Moving the first size selector in a second direction causes the first cushion and the second cushion to simultaneously decrease from the second size to the first size. In the first size, the first and second cushion have supra-aural properties. In the second size, the first and the second cushion have circum-aural properties. If the linkage is disengaged, a size of the first cushion and the second cushion may be independently adjusted.

20 Claims, 5 Drawing Sheets

ADJUSTING A SIZE OF HEADPHONE CUSHIONS

BACKGROUND OF THE INVENTION

Field of the Invention

This invention relates generally to headphone cushions and, more particularly to providing enabling a user to independently adjust a size of each headphone cushion to accommodate different sized ears and to enable the headphone cushions to be adjusted from circum-aural to supra-aural.

Description of the Related Art

As the value and use of information continues to increase, individuals and businesses seek additional ways to process and store information. One option available to users is information handling systems (IHS). An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

A headphone may be used to listen to music played back by an IHS, such as, for example, a smartphone, a smartwatch, a tablet, a laptop, a desktop, a television, or another type of media playback device. In the case of a device, such as a smartphone, that is capable of receiving and originating audio calls and/or video calls, the media playback device may have an attached microphone.

For a conventional headphone, headphone cushions are fixed in size. However, the size and shape of human ears may vary. Thus, a user desiring a headphone may audition numerous headphones to identify a headphone with cushions that are comfortable to the user's ears.

In addition, conventional headphones are designed with cushions that are either circum-aural or supra-aural. Circum-aural cushions cover the external portion of the ear (referred to as the pinna). Circum-aural cushions are designed to go around and enclose the user's ears to provide insulation from external noises. Thus, a user may use a headphone with circum-aural cushions in a noisy environment, such as in a commuter vehicle, in an office, or the like, to prevent external noises from intruding in on the user's listening experience. Supra-aural headphones have cushions that press against the ears, rather than enclose the ears, resulting in less attenuation of external noises. Thus, a user may use a headphone with supra-aural cushions in a relatively quiet environment, such as at home, to enable the user to hear external sounds, such as monitoring children playing or enabling the user's spouse to obtain the user's attention.

Thus, a user may have to audition numerous headphones to identify a particular headphone that comfortably fits the user's ears. In addition, the user may purchase at least one circum-aural headphone and one supra-aural headphone to accommodate the different situations in which the user may listen to music.

SUMMARY OF THE INVENTION

This Summary provides a simplified form of concepts that are further described below in the Detailed Description. This Summary is not intended to identify key or essential features and should therefore not be used for determining or limiting the scope of the claimed subject matter.

For example, a headphone includes a headband, a left housing with a left cushion and a left size selector, and a right housing with a right cushion and a right size selector. A linkage connects the left size selector to the right size selector. If the linkage is engaged, moving the left size selector in a first direction causes the left cushion and the right cushion to simultaneously increase from a first size to a second size. Moving the left size selector in a second direction causes the left cushion and the right cushion to simultaneously decrease from the second size to the first size. In the first size, the left and right cushion have supra-aural properties. In the second size, the left and the right cushion have circum-aural properties. If the linkage is disengaged, a size of the left cushion and the right cushion may be independently adjusted.

BRIEF DESCRIPTION OF THE DRAWINGS

A more complete understanding of the present disclosure may be obtained by reference to the following Detailed Description when taken in conjunction with the accompanying Drawings. In the figures, the left-most digit(s) of a reference number identifies the figure in which the reference number first appears. The same reference numbers in different figures indicate similar or identical items.

DETAILED DESCRIPTION

Figure 1:
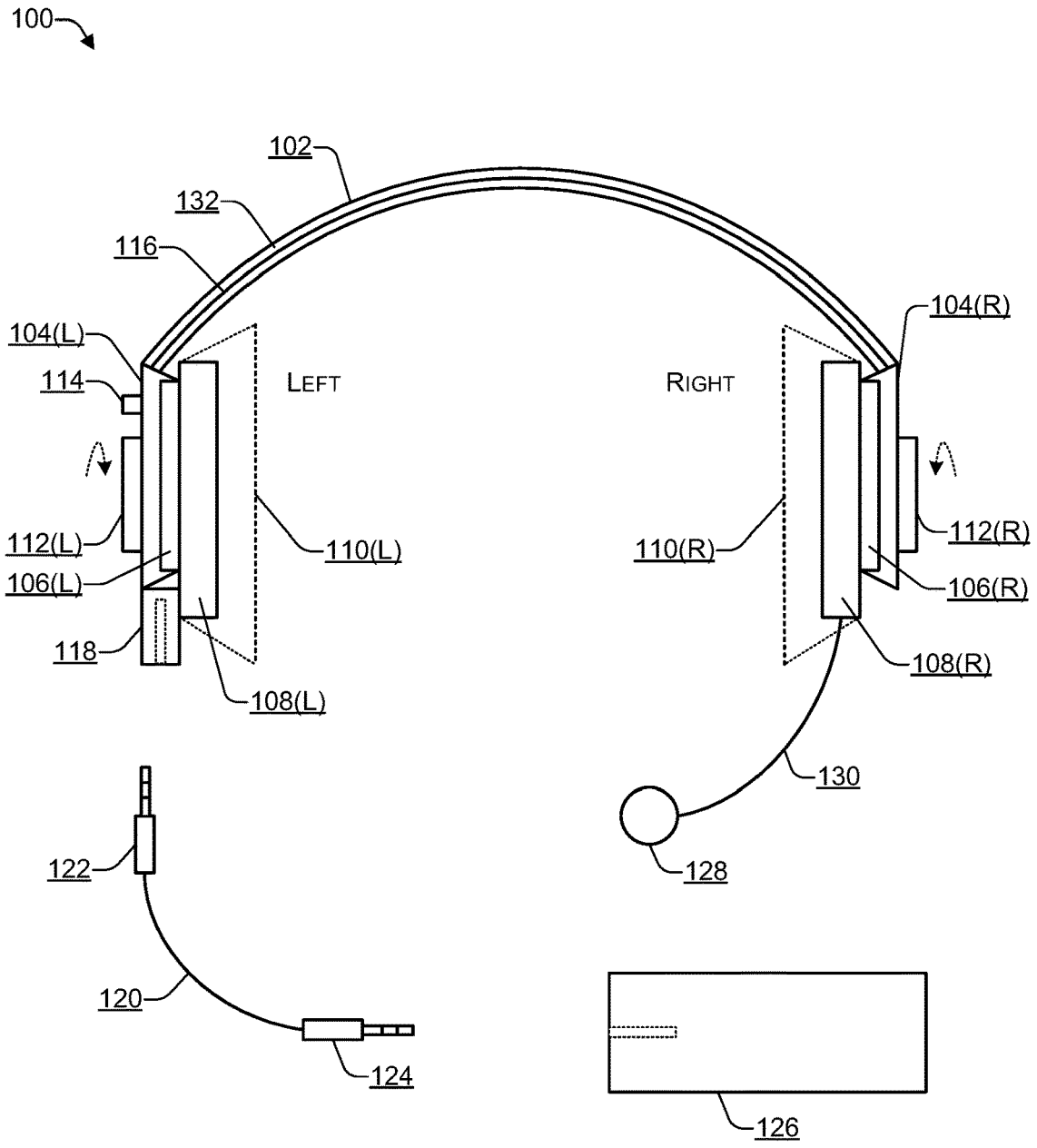
FIG. 1 is a block diagram of a headphone, according to some embodiments.

For purposes of this disclosure, an information handling system (IHS) may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or video display. The information handling system may also include one or more buses operable to transmit communications between the various hardware components.

The systems and techniques described herein enable a size of cushions of a headphone to be modified. A headphone may also be referred to as a pair of headphones because each headphone has two transducers and two cushions. The size of the cushions may be modified to accommodate different ear sizes, enabling a pair of headphones to be used by a wide variety of people having ears with different sizes and shapes. In addition, a user can select a smaller cushion size when the user desires supra-aural headphones and can select a larger cushion size when the user desires circum-aural headphones. Furthermore, the user can decouple the cushion sizes and configure one cushion with a smaller cushion size and one cushion with a larger cushion size. For example, the user may have one ear with a size and/or shape that is significantly different from the other ear and thus may desire a different sized cushion for each ear. As another example, the user may, in some situations, such as when performing as a disc jockey (DJ), desire that one cushion be configured as a circum-aural cushion (e.g., to enable the user to hear the music) and other cushion be configured as a supra-aural cushion (e.g., to enable the user to hear external sounds, such as the crowd).

As a first example, a headphone may include: (i) a headband, (ii) a left (e.g., first) housing attached to a first end of the headband, and (iii) a right (e.g., second) housing attached to a second end of the headband. The left housing may include: a left transducer, a left cushion, and a left size selector. Moving the left size selector a first amount in a first direction causes the left cushion to increase in size. Moving the left size selector the first amount in a second direction (that is opposite the first direction) causes the left cushion to decrease in size. An amount that the left cushion increases in size or decreases in size is proportional (e.g., linearly or exponentially proportional) to the first amount. The right housing may include: a right transducer, a right cushion, and a right size selector. Moving the right size selector a second amount in the first direction causes the right cushion to increase in size. Moving the right size selector the second amount in the second direction causes the right cushion to decrease in size. The amount that the right cushion increases in size or decreases in size is proportional (e.g., linearly or exponentially proportional) to the second amount. Using the left size selector and the right size selector, a length of the left cushion and the right cushion may be varied between about 50 millimeters (mm) to about 70 mm, a width of the left cushion and the right cushion may be varied between about 35 mm to about 45 mm, and a depth of the left cushion and the right cushion may be varied between about 5 mm to about 40 mm. The headphone may include a linkage selector to engage or disengage a linkage between the left size selector and the right size selector. For example, when the linkage selector engages the linkage, moving the left size selector in the first direction causes both the left cushion and the right cushion to simultaneously increase in size, and moving the left size selector in the second direction causes both the left cushion and the right cushion to simultaneously decrease in size. The headphone may include a communications interface in either the left housing or the right housing. The communications interface includes at least one of: (i) a wireless communications interface, such as Wi-Fi®, Bluetooth®, apt-X, or the like, or (ii) an electronic receptacle to accept a jack attached to a cable. The headphone may include a boom comprised of a flexible metal rod. A first end of the boom is attached to either the left housing or the right housing and a microphone is attached to a second end of the boom.

As a second example, a headphone may include: (i) a headband having a cavity, (ii) a left (e.g., first) housing, (iii) a right (e.g., second) housing, and (iv) a linkage. The left housing is attached to a first end of the headband. The left housing includes: a left transducer, a left cushion, and a left size selector. The right housing is attached to a second end of the headband that is opposite the first end. The first housing includes: a right transducer, a right cushion, and a right size selector. The linkage runs through the cavity within the headband. The linkage is connected to the left size selector and to the right size selector. Moving the left size selector in a first direction causes the left cushion and the right cushion to simultaneously increase from a first size to a second size. Moving the left size selector in a second direction (e.g., that is opposite the first direction) causes the left cushion and the right cushion to simultaneously decrease from the second size to the first size. Moving the left size selector a first amount in the first direction causes the left cushion and the right cushion to increase in size proportionally (e.g., linearly or exponentially) to the first amount. Moving the left size selector a second amount in the second direction causes the left cushion and the right cushion to decrease in size proportionally to the second amount. In the first size, the left cushion and the right cushion have supra-aural properties. In the second size, the left cushion and the right cushion have circum-aural properties. The headphone may include a linkage selector to disengage the linkage that is connected to the left size selector and to the right size selector. After the linkage selector disengages the linkage, moving the left size selector in the first direction causes the left cushion to increase in size independently of the right cushion and moving the left size selector in the second direction causes the left cushion to decrease in size independently of the right cushion. After the linkage selector disengages the linkage, moving the right size selector in the first direction causes the right cushion to increase in size independently of the left cushion, and moving the right size selector in the second direction causes the right cushion to decrease in size independently of the left cushion. The first direction is one of: clockwise, counter-clockwise, up, down, left, or right.

As a third example, a headphone may include: (i) a headband, (ii) a left (e.g., first) housing attached to a first end of the headband, (iii) a right (e.g., second) housing attached to a second end of the headband that is opposite the first end, and (iv) a linkage that runs through a cavity within the headband. The linkage is connected to the left size selector and to the right size selector. The left housing includes: a left speaker, a left cushion, and a left size selector. The right housing includes: a right speaker, a right cushion, and a right size selector. A left extension of the left cushion may be stored in a compressed form in the left housing. A right extension of the right cushion may be stored in the compressed form in the right housing. Moving the left size selector in a first direction causes the left extension of the left cushion to be extracted from the left housing while simultaneously causing the right extension of the right cushion to be extracted from the right housing. Moving the left size selector in a second direction (e.g., opposite the first direction) causes the left extension of the left cushion to be stored in the compressed form in the left housing while simultaneously causing the right extension of the right cushion to be stored in the compressed form in the right housing. The headphone may include a linkage between the left size selector and the right size selector. The linkage may pass through a cavity within the headband. A first end of the linkage is connected to the left size selector and a second end of the linkage is connected to the right size selector. The headphone may include a linkage selector to disengage the linkage between the left size selector and the right size selector. For example, after the linkage selector disengages the linkage, moving the left size selector in the first direction causes the left cushion to increase in size independently of the right cushion and moving the left size selector in the second direction causes the left cushion to decrease in size independently of the right cushion. Moving the right size selector in the first direction causes the right cushion to increase in size independently of the left cushion and moving the right size selector in the second direction causes the right cushion to decrease in size independently of the left cushion. After moving the left size selector a first amount in the first direction, the left cushion and the right cushion increase in size proportional to the first amount. After moving the right size selector a second amount in the second direction, the left cushion and the right cushion decrease in size proportional to the second amount. The left cushion and the right cushion may each include open-cell (e.g., acoustically transparent) foam.

FIG. 1 is a block diagram of a headphone, according to some embodiments. The headphone 100 may include a headband 102. On either side (e.g., (L)=left side and (R)=right side) of the headband 102, a housing 104(L), 104(R) may include a transducer (e.g., a speaker) 106(L), 106(R). A cushion 108(L), 108(R) may be attached to the housing 104(L), 104(R), respectively, and may be increased in size to create a larger sized cushion 110(L), 110(R), respectively using a size selector 112(L), 112(R). For example, moving one of the size selectors 112(L), 112(R) in a first direction (e.g., clockwise) may cause the associated cushion 108(L), 108(R) to increase in size to create one of the larger sized cushions 110(L), 110(R). Moving one of the size selector 112(L), 122(R) in a second direction (e.g., counter-clockwise), that is opposite the first direction, may cause the larger sized cushions 110(L), 110(R) to decrease in size to create the cushions 108(L), 108(R). The cushions 108(L), 108(R) may increase or decrease in size proportionally to an amount that the size selector 112 is moved. Note that moving (e.g., rotating) the size selector does not affect an orientation of the housings 106(L), 106(R).

Each of the cushions 108, 110 may be adjustable to a size from between about 50 millimeters (mm) by 35 mm by 5 mm (length×width×depth) to about 70 mm by 45 mm by 40 mm (length×width×depth). For example, the cushions 108 may have a size of about 50 mm×35 mm×5 mm while the cushions 110 may have a size of about 70 mm by 45 mm by 40 mm. Depth may also be referred to as thickness. The cushions 108(L), 108(R) may have supra-aural properties, e.g., allowing external sounds to be heard while the headphones 100 are being worn. The cushions 110(L), 110(R) may have circum-aural properties, e.g., blocking external sounds from being heard while the headphones 100 are being worn.

In some cases, the headphone 100 may automatically determine a size of the cushions 108, 110, (i) based on a position of one of the selectors 112, when the linkage selector 114 has engaged the linkage 116, or (ii) based on a position of each of the selectors 112(L), 112(R), when the linkage selector 114 has disengaged the linkage 116. Based on the size of the cushions 108, 110, the headphones 100 may automatically use a digital filter to modify a frequency response of the transducers 106(L), 106(R). To illustrate, a small computing device circuit, such as a system on a chip (SOC), may be located in one of the housings 104(L), 104(R). The digital filter may be a software application executed by the small computing device circuit to modify frequencies in the music being played back by the transducers 106(L), 106(R). For example, because the cushions 108(L), 108(R) have supra-aural properties, the filter circuit may provide a bass-boost by increasing an amount of gain of frequencies between 10 Hertz (Hz) to about 100 Hz. As another example, because the cushions 108(L), 108(R) have supra-aural properties, the filter circuit may provide a loudness curve (e.g., Fletcher Munson loudness curve), by increasing an amount of gain of bass frequencies between 10 Hz to about 100 Hz and increasing an amount of gain of treble frequencies between about 1000 Hz to 10,000 Hz.

Enabling a linkage selector 114 may enable a linkage 116 (e.g., a cable) between the size selectors 112(L), 112(R), thereby enabling the user to move a single one of the size selectors 112(L) or 112(R) to control a size of both cushions 108(L), 108(R) simultaneously. For example, when the linkage selector 114 is enabled, moving one of the size selectors 112(L) or 112(R) in the first direction may cause both of the cushions 108(L), 108(R) to substantially simultaneously increase in size to create the larger sized cushions 110(L), 110(R) and moving one size selectors 112(L) or 112(R) in the second direction may cause both of the cushions 110(L), 110(R) to substantially simultaneously decrease in size back to the cushions 108(L), 108(R). Disabling the linkage selector 114 may enable the user to independently adjust the size of each cushion. For example, when the linkage selector 114 is disabled, moving the size selector 112(L) in the first direction causes the corresponding cushion 108(L) to increase in size to create the larger sized cushion 110(L), without affecting the cushion 108(R). When the linkage selector 114 is disabled, moving the size selector 112(R) in the first direction causes the corresponding cushion 108(R) to increase in size to create the larger sized cushion 110(R), without affecting the cushion 108(L). When the linkage selector 114 is disabled, moving the size selector 112(L) in the second direction causes the corresponding cushion 110(L) to decrease in size to the cushion 108(L). When the linkage selector 114 is disabled, moving the size selector 112(R) in the second direction causes the corresponding cushion 110(R) to decrease in size to the cushion 108(R). The headband 102 may include a cavity 132 (e.g., a hollow channel) through which the linkage 116 runs from the left size selector 112(L) to the right size selector 112(R). The linkage 116 may be a mechanical linkage, such as a cable (e.g., a metal cable or a polypropylene cable). In some cases, the mechanical linkage may include a spring-loaded spool located in one or both of the housings 104(L), 104(R). When the linkage selector 114 engages the linkage 116, moving one of the size selectors 112(L), 112(R) may cause the linkage 116 (e.g., cable) to be wound on to the spool. When the linkage selector 114 disengages the linkage 116, the spring-loaded mechanism may release the linkage 116 (e.g., cable) from the spool.

At its smallest size, an extension portion (e.g., 20% to 60%) of each of the cushions 108(L), 108(R) may be stored in the respective housings 104(L), 104(R) in a compressed form. For example, the cushions 110(L), 110(R) may be made using an open cell foam, enabling the foam of the extension portions to be stored in a compressed form in the housings 104(L), 104(R). Moving one or both (depending on whether the linkage 116 is engaged or disengaged) of the size selectors 112 in the first direction may cause the extension portions of the cushions 108(L), 108(R) that was stored (in a compressed form) in the housings 104(L), 104(R) to be extracted from the respective housings 104(L), 104(R). For the larger sized cushions 110(L), 110(R), the extension portions of the cushions 108(L), 108(R) were previously extracted from the respective housings 104(L), 104(R). Moving one or both (depending on whether the linkage 116 is engaged or disengaged) of the size selectors 112 in the second direction may cause the extension portion of the cushions 108(L), 108(R) to be retracted and stored in the respective housings 104(L), 104(R).

The headphone 100 may include a communication interface 118. For example, the communication interface 118 may include a wireless interface that enables the headphones 100 to wirelessly receive (and in some cases send) audio data. To illustrate, the communication interface 118 may use a wireless standard, such as, for example, Wi-Fi®, Bluetooth®, apt-X, or the like, to wireless communicate audio data. The communication interface 118 may, in some cases, include an electronic receptacle to enable a cable 120 to connect the headphone 100 to a media playback device 126 (e.g., an information handling system). For example, a first jack 122 of the cable 120 may engage with the electronic receptacle of the communications interface 118 while a second jack 124 may engage with an electronic receptacle of the media playback device 126. Alternately, the communication interface 118 may communicate with the media playback device 126 via a wireless technology, such as Wi-Fi®, Bluetooth®, or the like. For wireless transmission, a wireless antenna may be located: inside the housing 106(L), inside the cavity of the headband 102, inside the housing 106(R), or any combination thereof.

In some cases, the headphone 100 may include a microphone 128 that is attached to the headphone by an adjustable boom 130. For example, the microphone 128 may be used by the user of the headphone 100 to answer or originate a phone call, to talk to other players when the user is playing a video game, and the like. In some cases, the boom 130 and the microphone 128 may be detachable from the headphone 100. For example, the user can detach the boom 130 and the microphone 128 from the headphones 100 to listen to music and attach the boom 130 and the microphone 128 to the headphones 100 to make a phone call or play a video game.

The headband 102 may be made using plastic. The cushions 108 may be made using an open-cell foam material that is relatively acoustically transparent (e.g., neutral). The boom 130 may be a flexible metal rod that is between about 75 mm to 150 mm in length. A user may use the flexibility of the boom 130 to manually position the microphone 128 near the user's mouth.

Figure 2A:
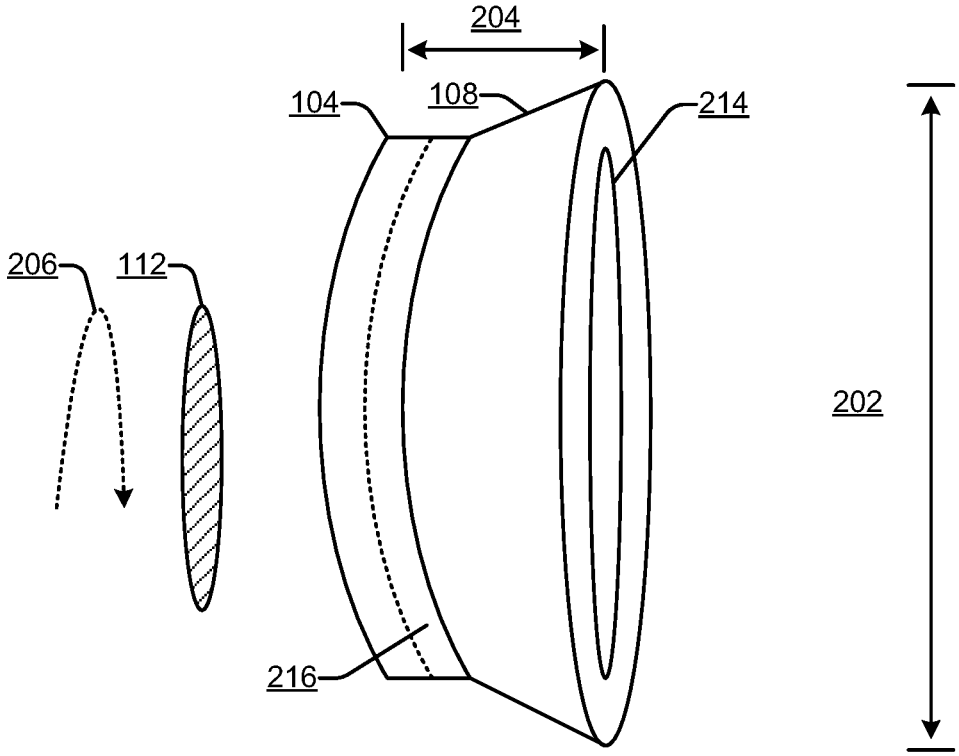
FIG. 2A illustrates a first perspective of a cushion in a supra-aural configuration, according to some embodiments.
Figure 2B:
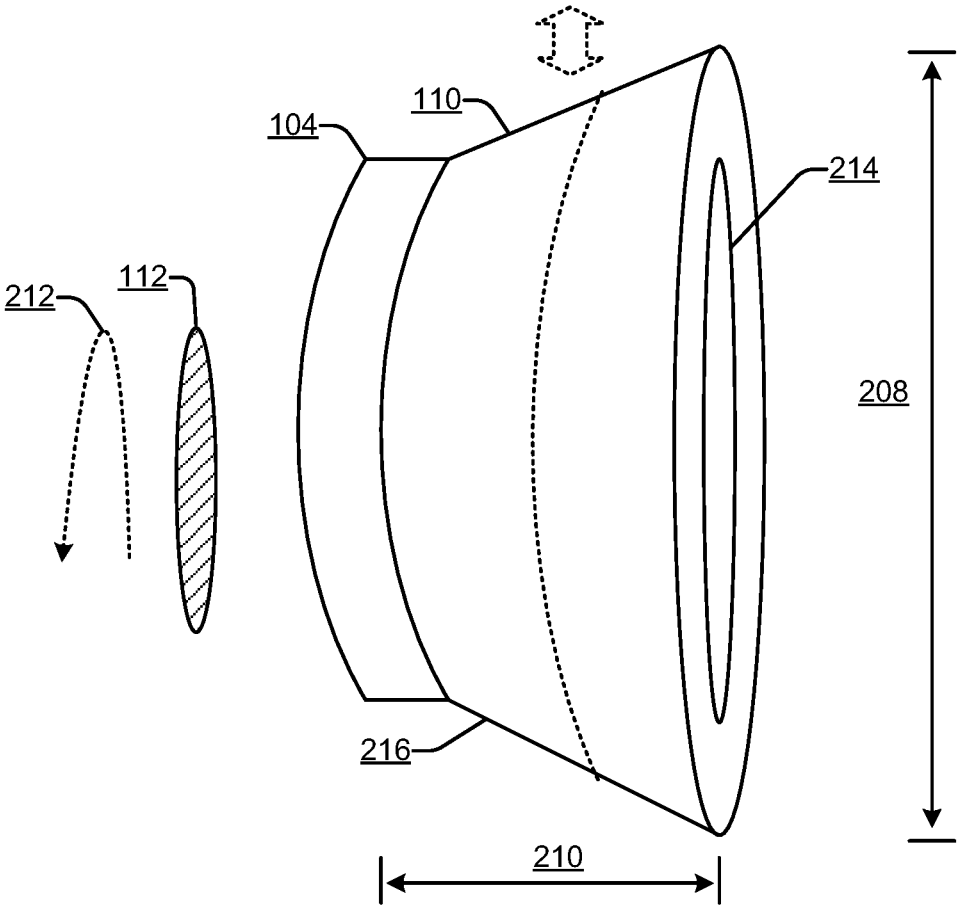
FIG. 2B illustrates a first perspective of a cushion in a circum-aural configuration, according to some embodiments.

FIG. 2A illustrates a first perspective of a cushion in an initial size (e.g., supra-aural configuration), according to some embodiments. The cushion 108 may have an initial size of an initial length 202 (e.g., 50 mm) and an initial depth 204 (e.g., 5 mm). In some cases, the cushion 108 may have an opening 214 into which an ear is placed. The cushion 110 may include an extension portion 216 that is stored in a compressed form in the corresponding housing 104. To increase a size of the cushion 108, the size selector 112 may be moved in a first direction 202 (e.g., clockwise) causing one (or both) of the cushions 108 to increase to a larger size, as illustrated in FIG. 2B. For example, moving the size selector 112 in the first direction 202 may cause the extension portion 216 to be extracted from the housing 104, thereby increasing the size of the cushion 108 to create the larger sized cushion 110.

FIG. 2B illustrates a first perspective of a cushion in a larger size (e.g., circum-aural configuration), according to some embodiments. The cushion 110 may have a size of about a length 208 (e.g., 70 mm) and about a depth 210 (e.g., 40 mm). The cushion 110 may include an extension portion 216 that was extracted from the housing 104 to increase the size of the cushion 108 to create the larger sized cushion 110. To decrease a size of the cushion 210, the size selector 112 may be moved in a second direction 212 (e.g., counter-clockwise) causing one (or both) of the cushions 108 to decrease to the size illustrated in FIG. 2A. The second direction 212 may be opposite the first direction 206 of FIG. 2A. For example, moving the size selector 112 in the second direction 202 may cause the extension portion 216 to be stored in a compressed form in the housing 104, thereby decreasing the size of the cushion 110 back to the cushion 108.

Figure 3A:
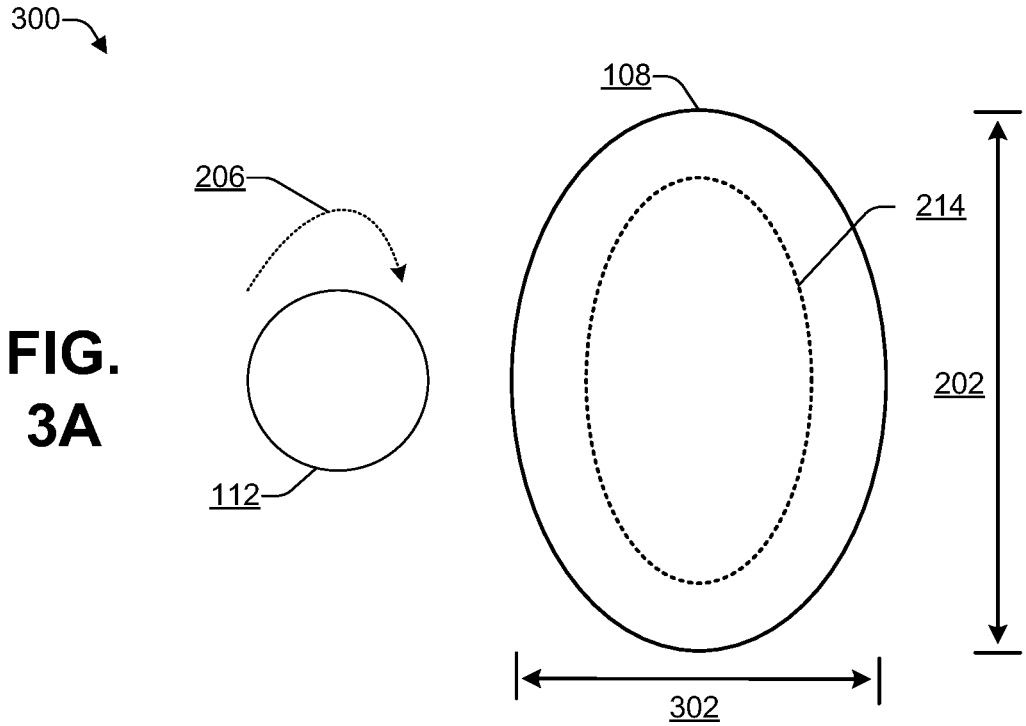
FIG. 3A illustrates a second perspective of a cushion in a supra-aural configuration, according to some embodiments.

FIG. 3A illustrates a second perspective of a cushion in an initial size (e.g., supra-aural configuration), according to some embodiments. The cushion 108 may have an initial size of the initial length 202 (e.g., 50 mm) and an initial width 302 (e.g., 35 mm). To increase a size of the cushion 108, the size selector 112 may be moved in the first direction 202 (e.g., clockwise) causing one (or both) of the cushions 108 to increase to a larger size as illustrated in FIG. 3B.

Figure 3B:
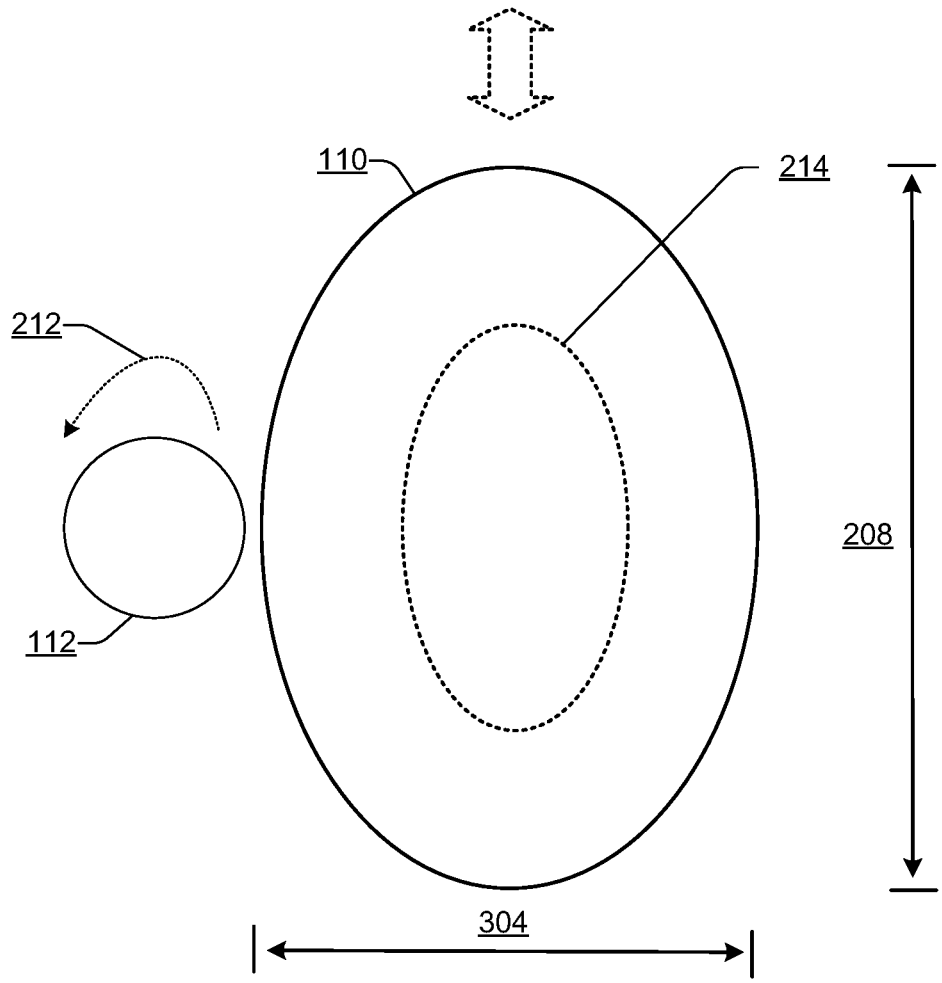
FIG. 3B illustrates a second perspective of a cushion in a circum-aural configuration, according to some embodiments.

FIG. 3B illustrates a second perspective of a cushion in a larger size (e.g., circum-aural configuration), according to some embodiments. The cushion 110 may have a size of about the length 208 (e.g., 70 mm) and about a width 304 (e.g., 45 mm). To decrease a size of the cushion 110, the size selector 112 may be moved in a second direction 212 (e.g., counter-clockwise) causing one (or both) of the cushions 110 to decrease to the size illustrated in FIG. 2A. The second direction 212 may be opposite the first direction 206 of FIG. 2A.

In FIGS. 1, 2A, 2B, 3A and 3B, if the first direction is clockwise then the second direction is counter-clockwise. If the first direction is counter-clockwise then the second direction is clockwise. While the size selector 112 is illustrated as being circular and examples of the movements are clockwise and counter-clockwise, the size selector 112 may, in other implementations, be a lever that can be moved up (e.g., first direction) and down (e.g., second direction) or left (e.g., first direction) and right (e.g., second direction) to increase a size of the cushions 108 or decrease the size of the cushions 110. Of course, other movements are also possible.

Figure 4:
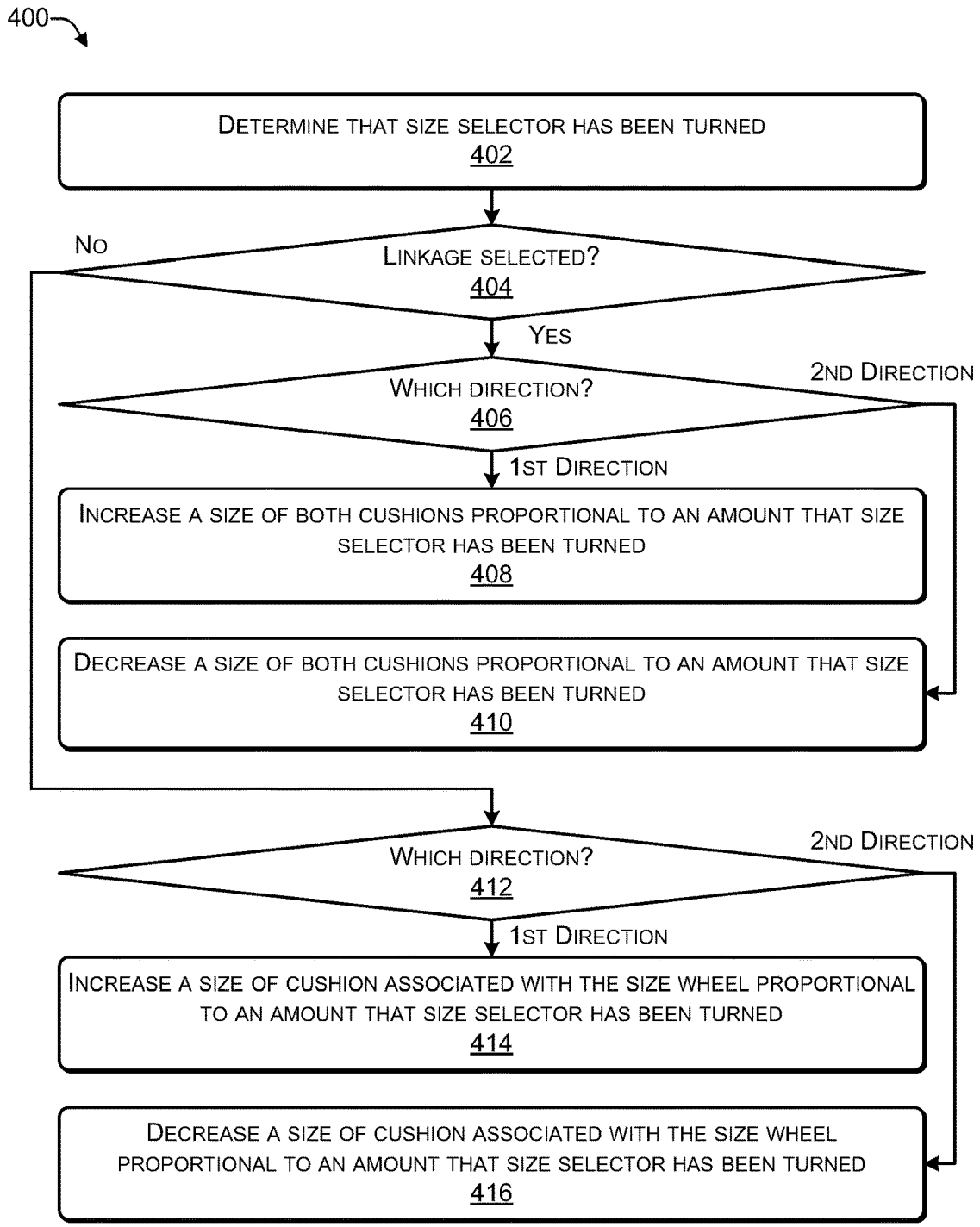
FIG. 4 is a flowchart of a process that includes modifying a size of one or both cushions of a headphone, according to some embodiments.

In the flow diagram of FIG. 4, each block represents one or more operations that can be implemented in hardware, software, or a combination thereof. In the context of software, the blocks represent computer-executable instructions that, when executed by one or more processors, cause the processors to perform the recited operations. Generally, computer-executable instructions include routines, programs, objects, modules, components, data structures, and the like that perform particular functions or implement particular abstract data types. The order in which the blocks are described is not intended to be construed as a limitation, and any number of the described operations can be combined in any order and/or in parallel to implement the processes. For discussion purposes, the process 400 is described with reference to FIGS. 1, 2A, 2B, 3A and 3B as described above, although other models, frameworks, systems and environments may be used to implement these processes.

FIG. 4 is a flowchart of a process 400 that includes modifying a size of one or both cushions of a headphone, according to some embodiments. The process 400 may be performed by the headphone 100 of FIG. 1.

At 402, a determination may be made that a size selector has been moved. At 404, a determination may be made whether a linkage selector is selected. In response to determining, at 404, that "yes" the linkage selector is selected, the process may proceed to 406. In response to determining, at 404, that "no" the linkage selector is not selected, the process may proceed to 412. For example, in FIG. 1, the headphone 100 may determine that one of the size selectors 112(L), 112(R) has been moved. The headphone 100 may be determine whether the linkage selector 114 has engaged or disengaged the linkage 116 between the size selectors 112 (L), 112(R).

At 406, a determination may be made as to which direction the size selector was moved. In response to determining, at 406, that the size selector was moved in the first direction, the process proceeds to 408, where a size of both cushions is increased an amount that is proportional to an amount that the size selector was moved. In response to determining, at 406, that the size selector was moved in the second direction, the process proceeds to 410, where a size of both cushions is decreased an amount that is proportional to an amount that the size selector was moved. For example, in FIG. 1, the headphone 100 may determine in which direction one of the size selectors 112(L), 112(R) was moved. If the headphones 100 determines that one of the size selectors 112(L), 112(R) was moved in a first direction, then the headphones 100 may increase a size of both cushions 108(L), 108(R) an amount that is proportional to an amount that one of the size selectors 112(L), 112(R) was moved. If the headphones 100 determine that one of the size selectors 112(L), 112(R) was moved in a second direction (e.g., opposite the first direction), then the headphones 100 may decrease a size of both cushions 110(L), 110(R) an amount that is proportional to an amount that one of the size selectors 112(L), 112(R) was moved.

At 412, a determination may be made as to which direction the size selector was moved. In response to determining, at 412, that the size selector was moved in the first direction, the process proceeds to 414, where a size of a cushion associated with the size selector is increased an amount that is proportional to an amount that the size selector was moved. In response to determining, at 412, that the size selector was moved in the second direction, the process proceeds to 416, where a size of a cushion associated with the size selector is decreased an amount that is proportional to an amount that the size selector was moved. For example, in FIG. 1, the headphone 100 may determine in which direction one of the size selectors 112(L), 112(R) was moved. If the headphones 100 determines that one of the size selectors 112(L), 112(R) was moved in a first direction, then the headphones 100 may increase a size of a corresponding one of the cushions 108(L), 108(R) a proportional amount. If the headphones 100 determine that one of the size selectors 112(L), 112(R) was moved in a second direction (e.g., opposite the first direction), then the headphones 100 may decrease a size of a corresponding one of the cushions 110(L), 110(R) a proportional amount.

Figure 5:
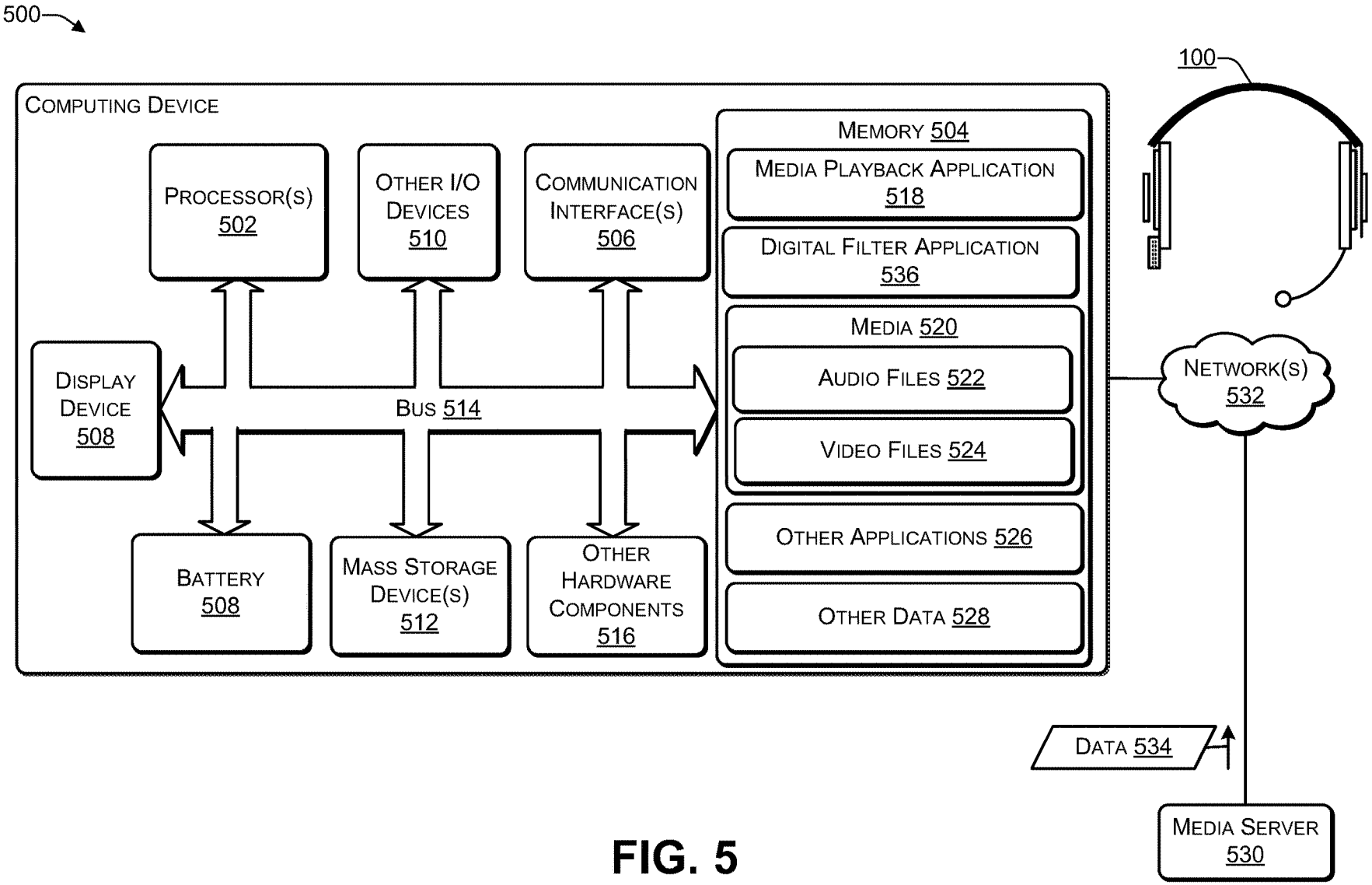
FIG. 5 illustrates an example configuration of a computing device that can be used to implement the systems and techniques described herein.

FIG. 5 illustrates an example configuration of the computing device 500 that can be used to implement the systems and techniques described herein, such as the media playback device 126 of FIG. 1 or the headphone 100. The computing device 102 may include one or more processors 502 (e.g., CPU, GPU, or the like), a memory 504, communication interfaces 506, a display device 508, other input/output (I/O) devices 510 (e.g., keyboard, trackball, and the like), one or more mass storage devices 512 (e.g., disk drive, solid state disk drive, or the like), and other hardware components 516, configured to communicate with each other, such as via one or more system buses 514 or other suitable connections. While a single system bus 514 is illustrated for ease of understanding, it should be understood that the system buses 514 may include multiple buses, such as a memory device bus, a storage device bus (e.g., serial ATA (SATA) and the like), data buses (e.g., universal serial bus (USB) and the like), video signal buses (e.g., ThunderBolt®, DVI, HDMI, and the like), power buses, etc.

The processors 502 are one or more hardware devices that may include a single processing unit or a number of processing units, all of which may include single or multiple computing units or multiple cores. The processors 502 may include a graphics processing unit (GPU) that is integrated into the CPU or the GPU may be a separate processor device from the CPU. The processors 502 may be implemented as one or more microprocessors, microcomputers, microcontrollers, digital signal processors, central processing units, graphics processing units, state machines, logic circuitries, and/or any devices that manipulate signals based on operational instructions. Among other capabilities, the processors 502 may be configured to fetch and execute computer-readable instructions stored in the memory 504, mass storage devices 512, or other computer-readable media.

Memory 504 and mass storage devices 512 are examples of computer storage media (e.g., memory storage devices) for storing instructions that can be executed by the processors 502 to perform the various functions described herein. For example, memory 504 may include both volatile memory and non-volatile memory (e.g., RAM, ROM, or the like) devices. Further, mass storage devices 512 may include hard disk drives, solid-state drives, removable media, including external and removable drives, memory cards, flash memory, floppy disks, optical disks (e.g., CD, DVD), a storage array, a network attached storage, a storage area network, or the like. Both memory 504 and mass storage devices 512 may be collectively referred to as memory or computer storage media herein and may be any type of non-transitory media capable of storing computer-readable, processor-executable program instructions as computer program code that can be executed by the processors 502 as a particular machine configured for carrying out the operations and functions described in the implementations herein.

The computing device 500 may include one or more communication interfaces 506 for exchanging data via a network (e.g., the network 156 of FIG. 1). The communication interfaces 110 can facilitate communications within a wide variety of networks and protocol types, including wired networks (e.g., Ethernet, DOCSIS, DSL, Fiber, USB etc.) and wireless networks (e.g., WLAN, GSM, CDMA, 802.11, Bluetooth, apt-X, Wireless USB, ZigBee, cellular, satellite, etc.), the Internet and the like. Communication interfaces 110 can also provide communication with external storage, such as a storage array, network attached storage, storage area network, cloud storage, or the like.

The display device 508 may be used for displaying content (e.g., information and images) to users. Other I/O devices 510 may be devices that receive various inputs from a user and provide various outputs to the user, and may include a keyboard, a touchpad, a mouse, a printer, audio input/output devices, and so forth.

The computer storage media, such as memory 504 and mass storage devices 512, may be used to store software and data. For example, the computer storage media may be used to store a media playback application 518 to playback media 520, including audio files 522 and video files 524. The computer storage media may be used to store other applications 526 and other data 528.

The computing device 100 may be connected to a media server 530 via a network 532. The computing device 100 may stream media files, such as data 534, over the network 532. The communication interface 506 may be used to playback media files and send audio data to the headphone 100 via a wired (e.g., the cable 120) or a wireless connection (e.g., Wi-Fi®, Bluetooth®, apt-X, or the like).

In some cases, the headphone 100 may automatically determine a size of the cushions 108, 110, of FIG. 1 (*i*) based on a position of one of the selectors 112, when the linkage selector 114 has engaged the linkage 116, or (ii) based on a position of each of the selectors 112(L), 112(R), when the linkage selector 114 has disengaged the linkage 116. Based on the size of the cushions 108, 110, the headphones 100 may automatically use a digital filter 536 to modify a frequency response of the transducers 106(L), 106(R). To illustrate, components of the computing device 100, may be located in one or more of the housings 104(L), 104(R). The digital filter 536 may be a software application to modify frequencies in the media 520 being played back by the headphone 100. For example, because the cushions 108(L), 108(R) have supra-aural properties, the filter circuit may provide a bass-boost by increasing an amount of gain of frequencies between 10 Hertz (Hz) to about 100 Hz. The bass boost may be reduced or eliminated when the cushions are larger sized because the larger sized cushions 110(L), 110(R) have circum-aural properties. As another example, because the cushions 108(L), 108(R) have supra-aural properties, the filter circuit may provide a loudness curve (e.g., Fletcher Munson loudness curve or similar), by increasing an amount of gain of bass frequencies between 10 Hz to about 100 Hz and increasing an amount of gain of treble frequencies between about 1000 Hz to 10,000 Hz. The loudness curve may be reduced or eliminated when the cushions are larger sized because the larger sized cushions 110(L), 110(R) have circum-aural properties.

The example systems and computing devices described herein are merely examples suitable for some implementations and are not intended to suggest any limitation as to the scope of use or functionality of the environments, architectures and frameworks that can implement the processes, components and features described herein. Thus, implementations herein are operational with numerous environments or architectures, and may be implemented in general purpose and special-purpose computing systems, or other devices having processing capability. Generally, any of the functions described with reference to the figures can be implemented using software, hardware (e.g., fixed logic circuitry) or a combination of these implementations. The term "module," "mechanism" or "component" as used herein generally represents software, hardware, or a combination of software and hardware that can be configured to implement prescribed functions. For instance, in the case of a software implementation, the term "module," "mechanism" or "component" can represent program code (and/or declarative-type instructions) that performs specified tasks or operations when executed on a processing device or devices (e.g., CPUs or processors). The program code can be stored in one or more computer-readable memory devices or other computer storage devices. Thus, the processes, components and modules described herein may be implemented by a computer program product.

Furthermore, this disclosure provides various example implementations, as described and as illustrated in the drawings. However, this disclosure is not limited to the implementations described and illustrated herein, but can extend to other implementations, as would be known or as would become known to those skilled in the art. Reference in the specification to "one implementation," "this implementation," "these implementations" or "some implementations" means that a particular feature, structure, or characteristic described is included in at least one implementation, and the appearances of these phrases in various places in the specification are not necessarily all referring to the same implementation.

Although the present invention has been described in connection with several embodiments, the invention is not intended to be limited to the specific forms set forth herein. On the contrary, it is intended to cover such alternatives, modifications, and equivalents as can be reasonably included within the scope of the invention as defined by the appended claims.

What is claimed is:

1. A headphone comprising:

a headband;

a first housing attached to a first end of the headband, the first housing comprising:

a first transducer;

a first cushion; and a first size selector, wherein:

moving the first size selector a first amount in a first direction causes the first cushion to increase in size; and moving the first size selector the first amount in a second direction causes the first cushion to decrease in size, wherein the second direction is opposite the first direction; and a second housing attached to a second end of the headband that is opposite the first end, the second housing comprising:

a second transducer;

a second cushion; and a second size selector, wherein:

moving the second size selector a second amount in the first direction causes the second cushion to increase in size; and moving the second size selector the second amount in the second direction causes the second cushion to decrease in size;

wherein:

a length of the first cushion and the second cushion is between about 50 millimeters (mm) to about 70 mm;

a width of the first cushion and the second cushion is between about 35 mm to about 45 mm; and a depth of the first cushion and the second cushion is between about 5 mm to about 40 mm.

2. The headphone of claim 1, wherein:
an amount that the first cushion increases in size or decreases in size is proportional to the first amount.
3. The headphone of claim 1, wherein:
an amount that the second cushion increases in size or decreases in size is proportional to the second amount.
4. The headphone of claim 1, wherein:
the first cushion and the second cushion have supra-aural properties; and
the first cushion and the second cushion each comprise open-cell foam.
5. The headphone of claim 1, further comprising:
a linkage selector to engage or disengage a linkage between the first size selector and the second size selector;
wherein when the linkage selector engages the linkage:
moving the first size selector in the first direction causes both the first cushion and the second cushion to simultaneously increase in size; and
moving the first size selector in the second direction causes both the first cushion and the second cushion to simultaneously decrease in size.
6. The headphone of claim 1, further comprising:
a communications interface included in either the first housing or the second housing, wherein the communications interface includes at least one of:
a wireless communications interface; or
an electronic receptacle to accept a jack attached to a cable.
7. The headphone of claim 1, further comprising:
a boom comprising a flexible metal rod, wherein a first end of the boom is attached to either the first housing or the second housing; and
a microphone that is attached to a second end of the boom.
8. A headphone comprising:
a headband including a cavity;
a first housing attached to a first end of the headband, the first housing comprising:
a first transducer;
a first cushion; and
a first size selector; and
a second housing attached to a second end of the headband that is opposite the first end, the first housing comprising:
a second transducer;
a second cushion; and
a second size selector;
a linkage that runs through the cavity of the headband and is connected to the first size selector and to the second size selector;
wherein:
moving the first size selector in a first direction causes the first cushion and the second cushion to simultaneously increase from a first size to a second size;
after moving the first size selector a first amount in the first direction, the first cushion and the second cushion increase in size proportional to the first amount; and
moving the first size selector in a second direction that is opposite the first direction causes the first cushion and the second cushion to simultaneously decrease from the second size to the first size.
9. The headphone of claim 8, wherein:
a length of the first cushion and the second cushion is between about 50 millimeters (mm) to about 70 mm;
a width of the first cushion and the second cushion is between about 35 mm to about 45 mm; and
a depth of the first cushion and the second cushion is between about 5 mm to about 40 mm.
10. The headphone of claim 8, further comprising:
after moving the first size selector a second amount in the second direction, an amount that the first cushion and the second cushion decrease in size is proportional to the second amount.
11. The headphone of claim 8, wherein:
in the first size, the first cushion and the second cushion have supra-aural properties.
12. The headphone of claim 8, wherein:
in the second size, the first cushion and the second cushion have circum-aural properties.
13. The headphone of claim 8, further comprising:
a linkage selector to disengage the linkage that is connected to the first size selector and the second size selector;
wherein after the linkage selector disengages the linkage:
moving the first size selector:
in the first direction causes the first cushion to increase in size independently of the second cushion; and
in the second direction causes the first cushion to decrease in size independently of the second cushion;
moving the second size selector:
in the first direction causes the second cushion to increase in size independently of the first cushion; and
in the second direction causes the second cushion to decrease in size independently of the first cushion.
14. The headphone of claim 8, wherein the first direction comprises one of:
clockwise;
counter-clockwise;
up;
down;
left; or
right.
15. A headphone comprising:
a headband;
a first housing attached to a first end of the headband, the first housing comprising:
a first speaker;
a first cushion; and
a first size selector; and
a second housing attached to a second end of the headband that is opposite the first end, the second housing comprising:
a second speaker;
a second cushion; and
a second size selector;
a linkage that runs through a cavity within the headband and is connected to the first size selector and to the second size selector;
wherein:
moving the first size selector in a first direction causes a first extension of the first cushion to be extracted from the first housing while simultaneously causing a second extension of the second cushion to be extracted from the second housing; and
moving the first size selector in a second direction causes the first extension of the first cushion to be stored in a compressed form in the first housing while simultaneously causing the second extension of the second cushion to be stored in the compressed form in the second housing.

16. The headphone of claim 15, further comprising:

a linkage between the first size selector and the second size selector, wherein:

the linkage passes through a cavity within the headband, a first end of the linkage is connected to the first size selector; and a second end of the linkage is connected to the second size selector.

17. The headphone of claim 16, further comprising:

a linkage selector to disengage the linkage between the first size selector and the second size selector;

wherein, after the linkage selector disengages the linkage:

moving the first size selector:

in the first direction causes the first cushion to increase in size independently of the second cushion; and in the second direction causes the first cushion to decrease in size independently of the second cushion;

moving the second size selector:

in the first direction causes the second cushion to increase in size independently of the first cushion; and in the second direction causes the second cushion to decrease in size independently of the first cushion.

18. The headphone of claim 15, wherein:

after moving the first size selector a first amount in the first direction, the first cushion and the second cushion increase in size proportional to the first amount.

19. The headphone of claim 15, wherein:

after moving the second size selector a second amount in the second direction, the first cushion and the second cushion decrease in size proportional to the second amount.

20. The headphone of claim 15, wherein:

the first cushion and the second cushion each comprise open-cell foam.

* * * * *